US005641037A

United States Patent [19]

Wise et al.

[11] Patent Number: 5,641,037

[45] Date of Patent: Jun. 24, 1997

[54] RAIL LUBRICATION APPARATUS

[75] Inventors: Bruce R. Wise, North Huntingdon; William T. Urmson, Jr., Valencia; John W. Mospan, Pittsburgh, all of Pa.

[73] Assignee: Portec, Inc., R M P Division, Pittsburgh, Pa.

[21] Appl. No.: 467,323

[22] Filed: Jun. 6, 1995

[51] Int. Cl.[6] ..... B61K 3/00

[52] U.S. Cl. ..... 184/3.1; 184/6.21; 104/279

[58] Field of Search ..... 164/3.1, 3.2, 6.21, 164/7.4, 2; 104/279; 238/338; 198/500; 138/DIG. 3

[56] References Cited

U.S. PATENT DOCUMENTS

| | | | |
|---|---|---|---|
| 1,880,672 | 10/1932 | Bates et al. | 184/3.1 |
| 1,979,307 | 11/1934 | Bates | 184/3.1 |
| 2,168,554 | 8/1939 | Bates | 184/3.1 |
| 2,168,577 | 8/1939 | Overmier et al. | 184/3.1 |
| 2,183,727 | 12/1939 | Stern | 184/3.1 |
| 2,285,082 | 6/1942 | Bolt | 184/3.1 |
| 2,664,113 | 12/1953 | Dodge | 248/228 |
| 2,884,093 | 4/1959 | Stewart | 184/3.1 |
| 2,929,466 | 3/1960 | McWilliams | 184/3.1 |
| 2,995,210 | 8/1961 | Stemberger | 184/3.1 |
| 3,147,822 | 9/1964 | Watts | 184/3.1 |
| 4,270,497 | 6/1981 | Valerio | 184/106 |
| 5,124,878 | 6/1992 | Martucci | 138/DIG. 3 |
| 5,348,120 | 9/1994 | Junk et al. . | |
| 5,394,958 | 3/1995 | Junk et al. | 184/3.1 |

FOREIGN PATENT DOCUMENTS

| | | | |
|---|---|---|---|
| 0622686 | 10/1962 | Belgium | 184/3.1 |

*Primary Examiner*—Thomas E. Denion
*Assistant Examiner*—Christopher Verdier
*Attorney, Agent, or Firm*—Webb, Ziesenheim Bruening Logsdon Orkin & Hanson, P.C.

[57] ABSTRACT

The invention is a wiping bar of a rail lubrication apparatus of the type used with a rail having a base with outwardly extending flanges, a head, and a web connecting the base and the head, where the lubrication apparatus is comprised of a wiping bar and a first set of clamps for maintaining the wiping bar in position with respect to the rail. The lubrication apparatus also comprises a pump actuator and a second set of clamps for maintaining the pump actuator in position with the rail. The rail lubrication apparatus may be used with a pump, responsive to the pump actuator, for pumping a lubricant from a reservoir to the wiping bar to form a complete rail lubrication system. Specifically, the wiping bar of the present invention includes an improved distribution blade over those known in the art. Further, the wiping bar of the present invention includes the improvement of coating the surface of the wiping bar contacting the lubricant with an anti-stick material.

9 Claims, 4 Drawing Sheets

RAIL LUBRICATION APPARATUS

BACKGROUND OF THE INVENTION

1. Field of the Invention

The present invention relates to improvements in an apparatus for lubricating rails and wheel flanges on a railroad.

2. Description of the Prior Art

In the operation of railroads, it has long been the practice to apply grease or similar gel-like lubricants to the sides of the rail at curves, turn-outs, switches and, in some cases, to the sections of track immediately before a switch. Such lubricants have been and still are applied to the inside sides of the rail head at these locations to reduce the friction which naturally occurs as a train's wheels, particularly the wheel flanges, contact the sides of the rail. The resulting reduction in friction reduces wear on both the rail itself and the wheel flanges and contributes to increased fuel consumption in the locomotion of the train. When such lubricant is dispensed on the rail immediately preceding a switch, the movement of the train tends to move the lubricant into the area of the switch so as to reduce the friction on the rail sections and wheel flanges as the train passes over the switch.

In furtherance of this practice, there have been many designs of lubricators and apparatus for securing them so as to permit the automatic application of a lubricant to the rail by reason of the train's passing. In some of these devices, it is the depression of the roadbed that triggers the dispensation of lubricant; in others, it is the tripping of a mechanical device, such as a lever or a plunger, by the train's wheels which activates a lubricant dispensing mechanism. Examples of such prior art devices are shown in U.S. Pat. Nos. 2,884,093; 2,518,786; 2,231,394 and 2,223,714. Common to these devices is the need for means to rigidly secure the device either to the rails or to the track roadbed so that lubricant can be dispensed repeatedly at the desired rate and at the needed location. In most cases, such means involve a mechanical connection to the rail itself, such as by bolting or clamping in various ways. Examples of such connection means are shown in U.S. Pat. Nos. 3,147,822 and 2,168,554.

The problems associated with these prior art devices are many. Among other things, these prior art devices are often mechanically complex and difficult to install in the field. As a result, they are also often difficult to maintain and, due to the complexity of their design features, they tend to loosen and then become less effective as they are subjected to vibrations and rail roadbed flexion from traffic and contraction/expansion of the rail from thermal stress. Further, none of the prior art devices can easily accommodate different rail sizes. In effect, these devices either need to be manufactured in different sizes to accommodate each rail size or they need to be adapted to different rail sizes through various shim arrangements or adjustment bolts. These features only add to the tendency of the prior art devices to loosen and become less effective as they are used. Finally, these devices are difficult or impossible to adjust for the effects of wear on the head and face (or side) of the rail.

U.S. Pat. Nos. 5,348,120 and 5,394,958 correct these problems with a rail lubricating system comprised of a wiping bar, a first set of clamps for maintaining the wiping bar in position with respect to the rail, a pump actuator, and a second set of clamps for maintaining the pump actuator in position with respect to the rail. A pump is responsive to the pump actuator for pumping a lubricant from a reservoir to the wiping bar. The wiping bar of U.S. Pat. Nos. 5,348,120 and 5,394,958 is comprised of a manifold body having a plurality of channels formed therein. Each channel has a common beginning point and a unique end point. All of the channels are of substantially equal length. A manifold port plate is connected to the manifold body so as to cover the channels. The manifold port plate has an opening coinciding with the common beginning point of each of the channels and a plurality of apertures, each aperture coinciding with one of the unique end points of the above-described channels. A front blade is connected to the manifold port plate. The front blade has an opening coinciding with the opening of the manifold port plate and a plurality of apertures, which may take the form of slots, coinciding with the apertures of the manifold port plate. A distribution blade has an opening coinciding with the opening of the front blade and a plurality of channels. One channel coincides with each of the apertures of the front blade. The channels extend upwardly to a top edge of the distribution blade whereby a path for a lubricant is provided through the channels of the manifold body, the apertures of the manifold port plate, the apertures of the front blade, and the channels of the distribution blade. A lubricant inlet port extends through the openings in the distribution blade and the front blade. The inlet port is connected to the opening in the manifold port plate to provide the lubricant to the common beginning point of the channels in the manifold body. Once adjusted to the rail size as described in U.S. Pat. Nos. 5,394,258 and 5,348,120 with the top of the front blade somewhat lower than the top of the distribution blade, lubricant is distributed toward the side of the rail head. A pump pumps lubricant from a reservoir to the wiping bar for application to the rail head.

The rail lubrication apparatus of U.S. Pat. Nos. 5,348,120 and 5,394,958 address many problems of the prior art in that the apparatus is easily installed in the field, is not mechanically complex, has few moving parts, is easily adaptable to multiple rail sizes, and is easily adjustable to accommodate worn rails.

It is an object of the present invention to improve over the rail lubrication apparatus described in U.S. Pat. Nos. 5,348,120 and 5,394,958, whereby the lubricant is more efficiently and uniformly applied to the rail.

SUMMARY OF THE INVENTION

The present invention relates generally to improvements in the wiping bar of a rail lubrication apparatus of the type used with a rail having a base with outwardly extending flanges, a head, and a web connecting the base and the head, where the lubrication apparatus is comprised of a wiping bar and a first set of clamps for maintaining the wiping bar in position with respect to the rail. The lubrication apparatus also comprises a pump actuator and a second set of clamps for maintaining the pump actuator in position with the rail. The rail lubrication apparatus may be used with a pump, responsive to the pump actuator, for pumping a lubricant from a reservoir to the wiping bar to form a complete rail lubrication system. Specifically, the wiping bar of the present invention includes an improved distribution blade over those known in the art. Further, the wiping bar of the present invention includes the improvement of coating the surface of the wiping bar contacting the lubricant with an anti-stick material.

BRIEF DESCRIPTION OF THE DRAWINGS

For the present invention to be easily understood and readily practiced, a preferred embodiment will now be described, by way of example only, with reference to the accompanying figures, wherein.

DESCRIPTION OF THE PREFERRED EMBODIMENTS

Figure 1:
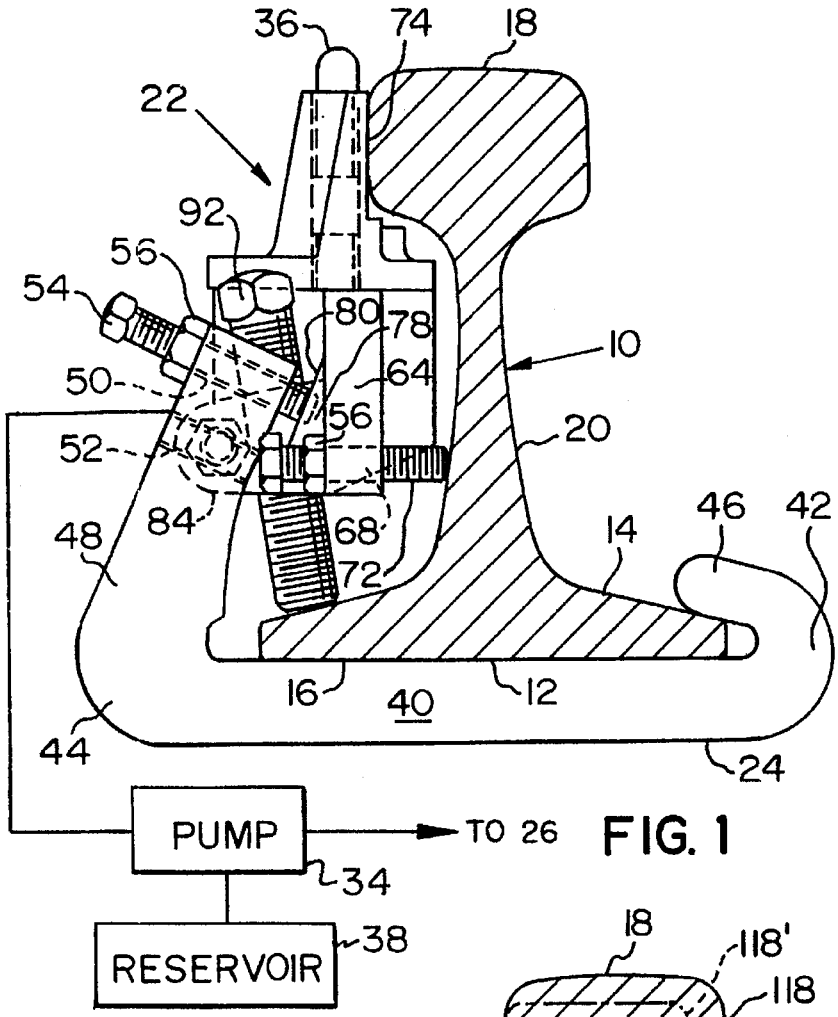
FIGS. 1 and 2 illustrate a lubricating system constructed according to the teachings of the present invention with FIG. 1 primarily illustrating a side view of a pump actuator held in position on a rail by a clamp and FIG. 2 illustrating a side view of a wiping bar held in position on a rail by a clamp.
Figure 2:
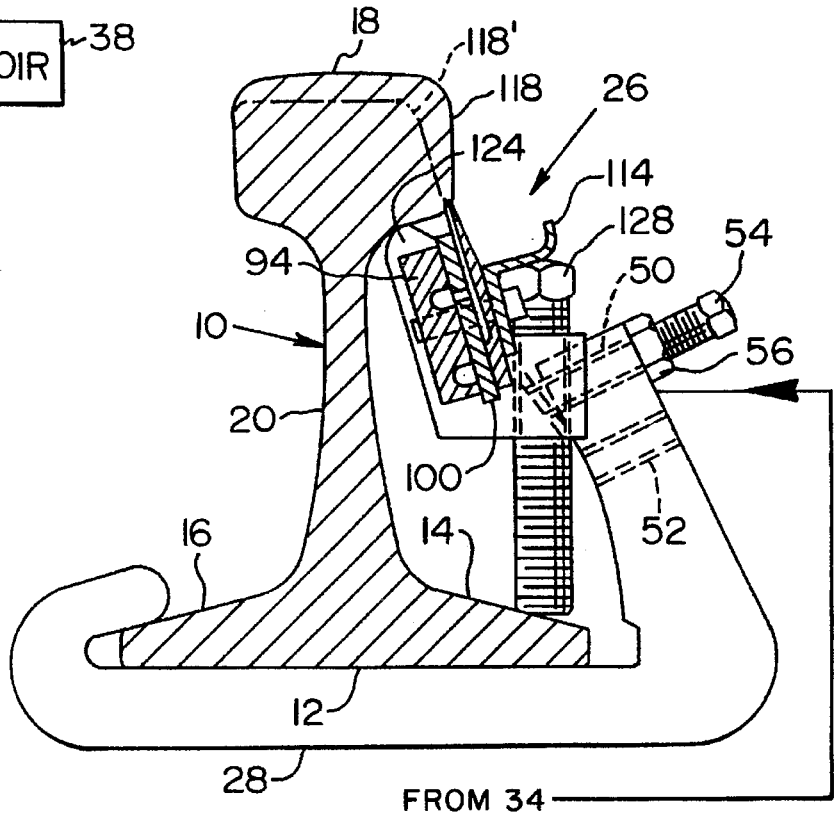

The present invention is directed to improvements over U.S. Pat. Nos. 5,348,120 and 5,394,958 and to the extent necessary to describe the present invention U.S. Pat. Nos. 5,348,120 and 5,394,958 are incorporated herein by reference. Turning to FIGS. 1 and 2, a railway rail lubrication apparatus and system constructed according to the teachings of the present invention is intended to be used with railway rails 10. The rail 10 is of the type having a base 12 with outwardly extending flanges 14 and 16. The rail 10 has a head 18 which is connected to the base 12 by a web 20.

The rail lubrication apparatus of the present invention is comprised of a pump actuator 22, seen in FIG. 1, a pair of clamps 24, one of which is seen in FIG. 1, for holding the pump actuator 22 in position with respect to the rail 10, a wiping bar 26, seen in FIG. 2, and a pair of clamps 28, one of which is seen in FIG. 2, for holding the wiping bar 26 in position with respect to the rail 10. The pump actuator 22 has an output port 30, seen in FIG. 7, and the wiping bar 26 has a lubricant inlet port 32 seen in FIG. 4. By virtue of the outlet port 30 and the lubricant inlet port 32, the pump actuator 22 and wiping bar 26, respectively, may be connected to a pump 34 for pumping a lubricant from a reservoir 38 to form a rail lubrication system.

It is desirable to provide lubrication to the area 118 of the railhead 18 on which railway wheel flanges ride. That desire may be due to curves, switches, or any other location where friction and excessive wear is a problem. The wiping bar 26 is appropriately positioned as shown in FIG. 2 to provide a lubricant to the area 118 of the railhead 18.

To facilitate application of the lubricant, the pump actuator 22 is positioned so that a plunger 36 carried thereby extends above the railhead 18. The pump actuator 22 is located on the side of the railhead 18 which is opposite of the side where the wheel flanges ride. When a railway wheel contacts plunger 36, plunger 36 is depressed thereby hydraulically actuating the pump 34, which may be any one of various well-known types of such pumps. Pump 34 pumps lubricant from the reservoir 38 to the wiping head 26 for application to the railhead. In that manner, application of the lubricant is effected when needed.

Clamps 24 and 28 are identical in construction and operation. In FIG. 1, the clamp 24 is illustrated as having a base section 40. The base section 40 has a first end 42 and a second end 44. Extending from the first end 42 is a hook 46 sized to receive the rail base flange 14. A projection 48 extends upwardly from the second end 44 at an angle (which may be ninety degrees) so as to not contact the rail base flange 16. As can be seen from the figure, the base section 40 of the clamp 24 is sufficiently long to enable the hook 46 to clear flange 14 during installation and, after installation, for the projection 48 to completely clear the flange 16. More specifically, the rigid projection 48 is displaced along the base section 40 a sufficient distance from the hook 46 to be slid under rail 10 and to engage the rail base flange 14 on the side of the rail opposite of the side on which the projection 48 is positioned. Providing a base section 40 of sufficient length is thus desirable to enable the clamp 24 to be easily attached in the field.

The projection 48 has a pair of threaded bores 50 and 52 extending therethrough. The two threaded bores 50 and 52 are provided to accommodate rails 10 having webs 20 of different sizes, although normally only one bore will be used. As shown in FIG. 1, the threaded bore 50 carries a hold-down screw 54. The projection 48 and the threaded bore 50 cooperate in such a manner that the hold-down screw 54 preferably projects from projection 48 at a predetermined angle. That angle may be, for example, a downwardly extending angle of about twenty-five degrees. Those of ordinary skill in the art will recognize that the desired angle can be achieved by the angle the projection 48 makes with the base section 40, the angle of the threaded bores 50 and 52, or some combination thereof. The purpose of the angle is to enable, upon tightening of hold-down screw 54 into contact with a device such as the pump actuator 22, the generation of a force or a moment to firmly hold the device in position with respect to the railhead and to generate an opposite force or moment tending to urge the clamp 24 in a clockwise direction as seen in FIG. 1. That moment keeps hook 46 firmly engaged with base flange 14 and keeps base section 40 in firm engagement with the rail base 12. Finally, a jam nut 56 may be provided so that the hold-down screw 54 remains in the desired position.

As seen from FIGS. 1 and 2, the clamps 24 and 28 may be comprised of a single piece. By virtue of their construction, they may be easily connected to a rail 10 in the field. Additionally, upon tightening of the hold-down screws 54, the clamps 24 and 28 provide a constant and firm force for maintaining the device in position with respect to the rail 10 and the clamps firmly attached to the rail.

Figure 7:
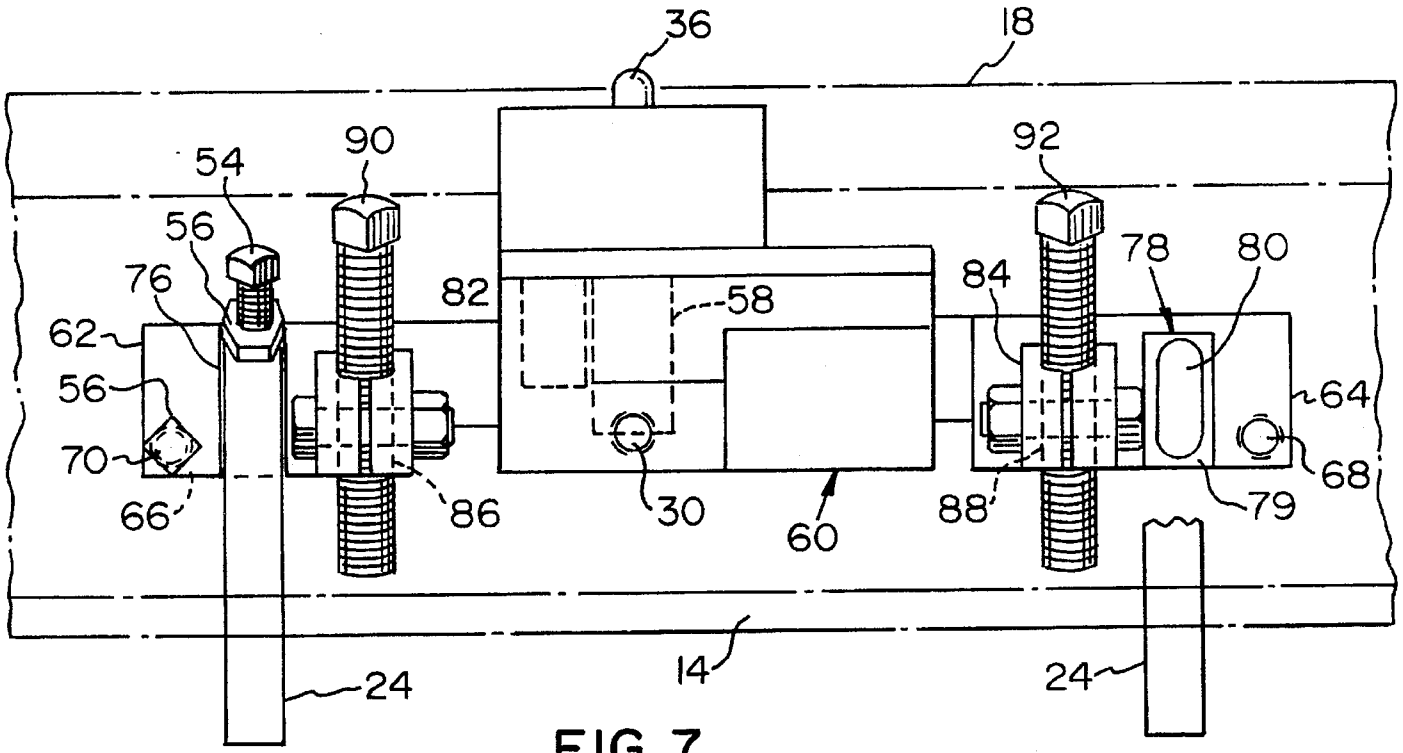
FIG. 7 is a plan view of the pump actuator held in position on a rail by a pair of clamps.
Figure 8:
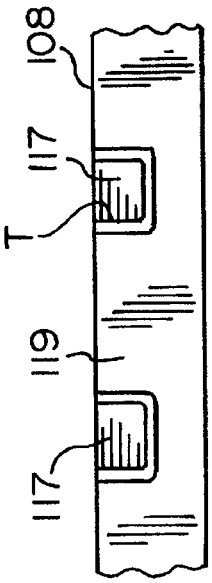
FIG. 8 is a section on line VIII—VIII of FIG. 4.

The pump actuator 22 will now be described in conjunction with FIGS. 1 and 7. The pump actuator 22 is comprised of a master cylinder 58 having the plunger 36 and the output port 30. The master cylinder 58 is carried by a frame member 60. The frame member 60 has two wing-like projections 62 and 64, seen best in FIG. 7. Each wing-like projection 62 and 64 has a threaded hole 66 and 68, respectively, extending horizontally therethrough. The threaded holes 66 and 68 carry threaded adjustment screws 70 and 72, respectively. The adjustment screws 70 and 72 may be provided with jam nuts 56. As an alternative to threaded holes and adjustment screws, solid stops could be used to position wing-like projections 62 and 64 with respect to web 20. The frame member 60 has a vertical face 74 formed therein for contacting the side of the head 18 of the rail 10.

Each of the wing-like projections 62 and 64 carries one of a first pair of brackets 76 and 78, respectively. The first pair of brackets 76 and 78 have a horizontal portion and a vertical portion. The vertical portion of the brackets 76 and 78 is connected to the wing-like projections 62 and 64, respectively. The brackets 76 and 78 are triangular in shape with the third side of the bracket forming an angled surface 79 which acts as a bearing surface for a hold-down screw. The hold-down screw may be the hold-down screw 54 of the clamp 24 previously discussed. Each of the angled surfaces 79 may have a groove 80 formed therein. The purpose of the groove 80 is to provide sidewalls for retaining the end of the hold-down screw 54. The interaction of the hold-down screw 54 with the angled surfaces 79 of the first pair of brackets 76 and 78 is described in greater detail hereinbelow.

Completing the description of the pump actuator 22, each of the wing-like projections 62 and 64 carries one of a second set of brackets 82 and 84, respectively. Each of the brackets 82 and 84 has a substantially horizontal portion and a vertical portion. Each bracket 82 and 84 is connected along its vertical portion to the wing-like members 62 and 64, respectively. The horizontal portions of each of the brackets 82 and 84 have threaded apertures 86 and 88 therethrough, respectively. Each of the threaded apertures 86 and 88 carries elevation screws 90 and 92, respectively. The elevation screws 90 and 92 are of sufficient length to facilitate contact with the rail base flange 16 when the vertical face 74 is engaging the vertical side of the head 18 of the rail 10. The order along the wing-like projections 62 and 64 of the holes 66 and 68, first brackets 76 and 78, and second brackets 82 and 84, respectively, is not critical. Thus, the second brackets 82 and 84 could be outboard of first brackets 76 and 78, respectively, as well as any other orientation of those components.

The adjustment screws 70 and 72, cooperating with threaded holes 66 and 68, respectively, and the elevation screws 90 and 92, cooperating with threaded apertures 86 and 88, respectively, constitute a means carried by the frame member 60 for positioning the vertical face 74 and plunger 36 with respect to the railhead 18. As can be seen, adjustment of the elevation screws 90 and 92 raises vertical face 74 and plunger 36 to the correct height for contacting the side of railhead 18. Adjustment of adjustment screws 70 and 72 varies the angle of the vertical face 74 and plunger 36 with respect to the railhead 18 so as to make vertical face 74 parallel to the side of railhead 18. By appropriate adjustment of adjustment screws 70 and 72 and elevation screws 90 and 92, the vertical face 74 and plunger 36 can be precisely positioned with respect to the railhead 18.

After proper positioning of the vertical face 74 and plunger 36 is completed, the hold-down screws 54 of the clamps 24 are tightened to bring the hold-down screws 54 into engagement with the angled surfaces 79 of brackets 76 and 78. As can be seen from FIG. 1, the force exerted by the hold-down screws 54 upon the angled surfaces 79 of brackets 76 and 78 generates a force which urges the pump actuator 22 into engagement with the rail 10. By virtue of that force, the clamps 24 maintain the pump actuator 22 in the desired position with respect to rail 10. Thus, the vertical face 74 and plunger 36 are held in the proper position at all times. The counter force generated urges the clamp 24 in a clockwise direction thereby maintaining constant and firm contact between hook 46 and flange 14 and between base section 40 and rail base 12.

Figure 3:
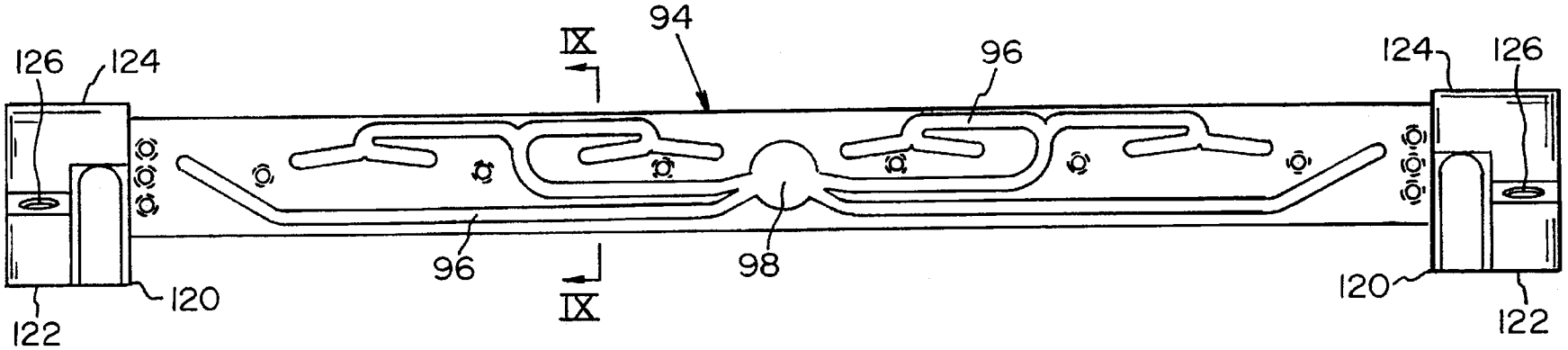
FIG. 3 is a plan view of the manifold body of the wiping bar.

The wiping bar 26 of the present invention will now be described in conjunction with FIGS. 2, 3, 4, 5, and 6. In FIG. 3, a manifold body 94 is illustrated. The manifold body 94 has a plurality of channels 96 milled, cast, or otherwise formed therein. The channels 96, share a common beginning point 98 although each channel 96 has a unique end point. As can be seen from FIG. 3, the length of each of the channels 96 from the common beginning point 98 to that channel's unique end point is substantially the same amongst all channels. That feature enables lubricant to be uniformly output from each of the channels 96.

A manifold port plate 100, seen in FIGS. 2, 4, 5, and 6, is connected to the manifold body 94 by screws 101 to cover the channels 96. The manifold port plate 94 has an opening 103, seen in FIG. 4, which coincides with the common beginning point 98 of each of the channels 96. The manifold port plate 100 also has a plurality of apertures 102, each coinciding with the unique end point of one of the channels 96.

A front blade 104 is connected to the manifold port plate 100 by screws 116 extending through slotted fastening apertures 107. The front blade 104 has an opening 105 coinciding with the opening 103 of the manifold port plate 100. The front blade 104 also has a plurality of slotted apertures 106 coinciding with the apertures 102 of the manifold port plate 100.

A distribution blade 108 is connected to the front blade 104 by screws 116. The distribution blade 108 has an opening 110 coinciding with the opening 105 of the front blade 104. The distribution blade 108 has a plurality of channels 112. Each of said channels 112 has a first lower portion 115 and a second upper portion 117. Located in upper portion 117 is separator or divider 119 which separates channel 112 into two discharge points. Separator 119 is preferably machined into channel 112. The inventors of the present invention have found that the separation of channel 112 into two discharge points results in markedly improved lubrication of rail 10 over U.S. Pat. Nos. 5,348,120 and 5,394,958. The separation of channel 112 into two discharge points results in the formation of far more lubrication points on rail 10 with a smaller amount of lubricant at each point. The result is that the same amount of lubricant lubricates rail 10 at more points than U.S. Pat. Nos. 5,348,120 and 5,394,958 and as the lubricant points are smaller in size, far less lubricant is lost to waste as is lost from the splattering of the larger lubricating points of U.S. Pat. Nos. 5,348,120 and 5,394,958.

Figure 4:
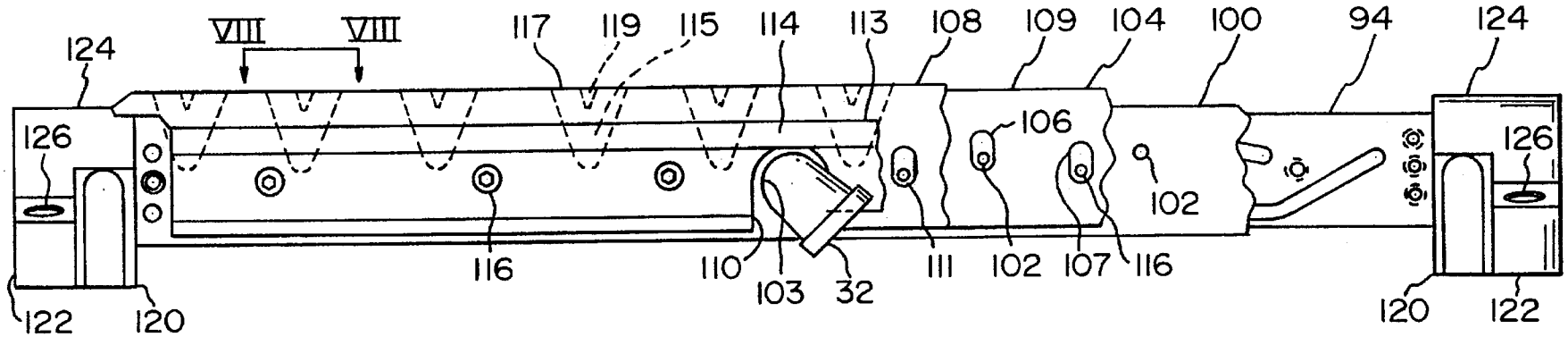
FIG. 4 is a plan view of the wiping bar with parts broken away.
Figure 5:
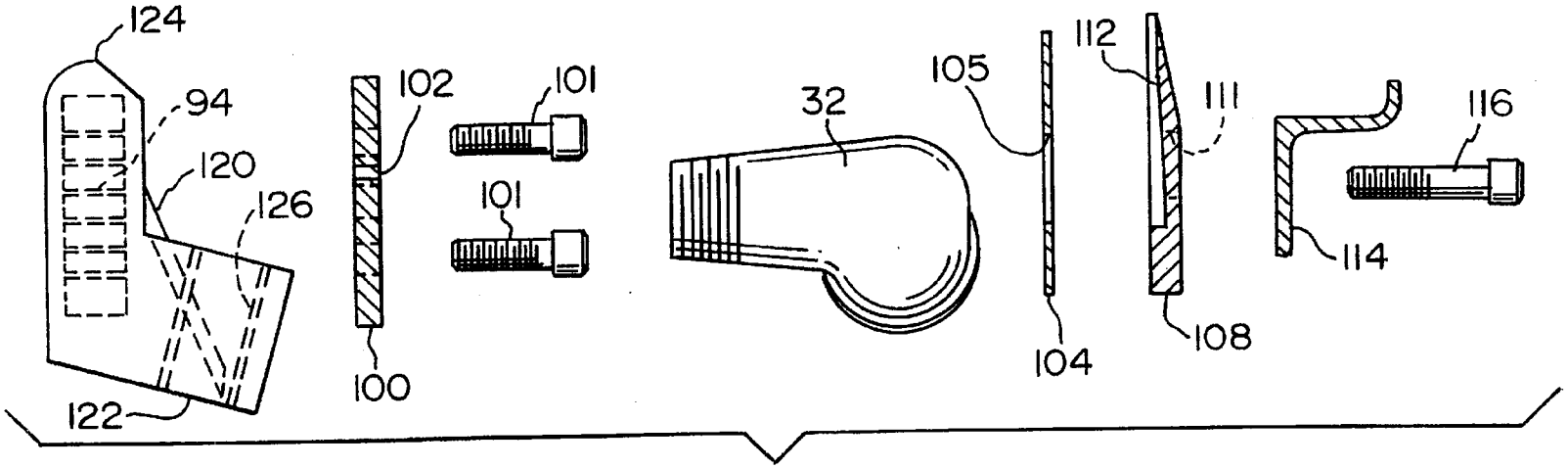
FIG. 5 is an exploded view illustrating the assembly of the components comprising the wiping bar.
Figure 6:
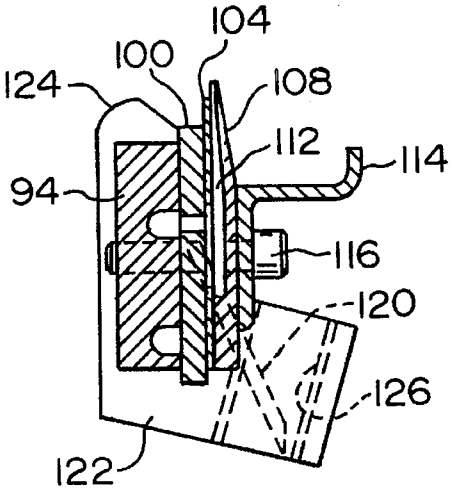
FIG. 6 is a cross-sectional view illustrating the components of FIG. 5 as they appear when assembled.
Figure 9:
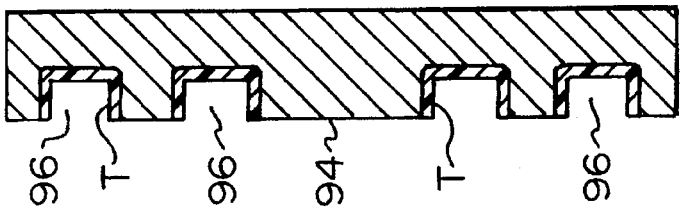
FIG. 9 is a section on line IX—IX of FIG. 3.

Each one of the lower portions 115 of the channels 112 coincides with one of the slotted apertures 106 of the front blade 104 and a plurality of slotted fastening apertures 111 for receiving screws 116. As seen in FIG. 4, each of the channels 112 extends upwardly to a top edge 113 of the distribution blade 108. A back bar 114 is connected to the distribution blade 108 to provide support and to act as a catch for any overflow of lubricant or grease. The screws 116 may be used to connect the front blade 104, distribution blade 108, and back bar 114 together and with the manifold body 94 and manifold port plate 100.

The lubricant inlet port 32 extends through the opening 110 in the distribution blade 108 and the opening 105 in the front blade 104 and is connected to the opening 103 in the manifold port plate 100 which coincides with the common beginning point 98. In that manner, a path for the lubricant is provided through inlet port 32 through each channel 96 from the common beginning point 98 to each channel's unique end point through the apertures 102 in the manifold port plate 100 through the slotted apertures 106 in the front blade 104 through the channels 112 in the distribution blade 108 to the top 113 of the distribution blade 108 and thence on to the face 118 of railhead 18.

The present inventors have also found that markedly improved lubrication of rail 10 results from the coating of all or a portion of the lubrication path described above with an anti-stick material. The anti-stick material permits the lubricant to follow along the described lubricant path with less pump pressure resulting in lower operating costs and longer pump life duration. It has been found that where the anti-stick coating is lacking, lubricant will gather and dry in the lubricant path resulting in the formation of solids which clog the lubricant path and require maintenance to clear such solids. The presence of the anti-stick coating lessens and may even prevent the possibility of the formation of such solids. While all or a portion of the lubricant path can be coated with the anti-stick material, it is at least essential that channels 96 milled in manifold body 94 are so coated with such a material T and that the channels 112 of distribution blade 108 are also so coated with such a material T. Suitable anti-stick materials include teflon or any other anti-stick coating which is impervious to the chemicals and solvents typically used to clean the wiping bar.

Because the front blade 104 has slotted apertures 106 and slotted fastening apertures 107 and because of the construction of channels 112 and the slotted fastening apertures 111 of the distribution blade 108, the front blade 104 and distribution blade 108 may be moved, in unison, in a vertical direction with respect to the manifold body 94, manifold plate 110, and back bar 114. That enables precise adjustment of the blades 104 and 108. A tab and slot arrangement, pin and hole arrangement (not shown), or some other similar mechanical device, may be carried by the front blade 104 and distribution blade 108 to ensure that those blades move in unison. Finally, a top edge 109 of the front blade 104 does not extend as high as the top edge 113 of distribution blade 108. That tends to urge the lubricant toward the rail face 118.

The wiping bar 26 carries a first pair of brackets 120. The first pair of brackets 120 is constructed in a manner similar to the first pair of brackets 76 and 78 of the pump actuator 22. Because the construction and operation of the first pair of brackets 120 of the wiping bar 26 is identical to the construction and operation of the first pair of brackets 76 and 78 previously discussed, that discussion will not be repeated here.

The wiping bar 26 also carries means for positioning to accommodate different rail sizes and to permit orientation of the distribution blade 108 with respect to the face 118 of railhead 18. That means is comprised of a second pair of brackets 122. The second pair of brackets 122 is constructed so as to have a substantially horizontal portion and a vertical portion. Each bracket 122 is connected along its vertical portion to either the first brackets 120 or the manifold body 94, depending upon which pair of brackets is the outboard pair. The vertical portion of the bracket 122 has a head 124 which extends above the manifold body 94. The head 124 is designed for engaging the underside of the head 18 of the rail 10 as shown in FIG. 2. The substantially horizontal portion of the brackets 122 has a threaded aperture 126. The threaded aperture 126 is adapted to receive an elevation screw 128. The elevation screws 128 are of sufficient length to facilitate contact with the rail base flange 14 when the heads 124 are engaging the underside of the railhead 18 of rail 10.

In operation, the wiping bar 26 is positioned with respect to the rail 10 as shown in FIG. 2. The heads 124 provide two contact points with the underside of the railhead 18 while the elevation screws 128 provide an additional two contacts with the rail base flange 14. By virtue of the elevation screws, the wiping bar 26 can accommodate rails of varying sizes. The wiping bar 26 may be positioned as shown in FIG. 2 so that the distribution blade 108 is tangent to a worn rail face 118' or the wiping bar 26 may be rotated slightly clockwise so that the distribution blade 108 is tangent to the rail face 118. Thus, by manipulation of the elevation screws 128 to take into account the size of the web 20, and appropriate rotation, clockwise or counterclockwise, of the wiping bar 26, the wiping bar 26 is brought into the proper position with respect to the rail face 118 or 118'. Thereafter, the height of the front blade 104 and distribution blade 108 may be adjusted as previously discussed.

After the distribution bar 26 has been properly positioned, the hold-down screws 54 of the clamps 28 are tightened to bring them into engagement with the angled surfaces 79 of the first pair of brackets 120. The forces exerted by the hold-down screws 54 on the angled surfaces firmly and uniformly hold the wiping bar 26 in position and the clamp 28 in engagement with the rail 10 as previously discussed. In that manner, the wiping bar 26 is maintained in the proper position at all times.

The apparatus and system of the present invention provides a simple, inexpensive structure that is surprisingly effective in the harsh environments encountered along railways.

While the present invention has been described in conjunction with a preferred embodiment thereof, many modifications and variations will be apparent to those of ordinary skill in the art. This disclosure and the following claims are intended to cover all such modifications and variations.

We claim:

1. A wiping bar for a rail lubricating apparatus of the type used with a rail having a base with outwardly extending flanges, a head, and a web connecting the base and the head, said wiping bar comprising:

a manifold body having a plurality of channels formed therein with a common beginning point and a unique end point;

a manifold port plate having an opening coinciding with said common beginning point of each of said channels and a plurality of apertures, each coinciding with one of said unique end points;

first means for connecting said manifold port plate to said manifold body so as to cover said channels;

a front blade having an opening coinciding with said opening of said manifold port plate and a plurality of apertures coinciding with said apertures of said manifold port plate;

a distribution blade having an opening coinciding with said opening of said front blade and a plurality of channels, each of said channels having an upper portion and a lower portion, each of said lower portions of each of said channels coinciding with each of said apertures of said front blade, each of said channels extending upwardly to said upper portion, said upper portion including at least one separator, said separator separating said upper portion of said channel into a plurality of discharge points, said upper portion extending upwardly to a top edge of said distribution blade whereby a path for a lubricant is provided through said channels in said manifold body, said apertures in said manifold port plate, said apertures in said front blade, and said channels in said distribution blade;

a back bar;

second means for connecting said front blade, said distribution blade, and said back bar, respectively, to said manifold port plate;

a lubricant inlet port extending through said openings in said distribution blade, said front blade, and said manifold port plate, said inlet port being connected to said manifold body so as to provide the lubricant to said common beginning point of said channels in said manifold body;

means connected to said manifold body for positioning said distribution blade with respect to a railhead; and a bearing surface connected to said manifold body for cooperating with a clamp means to maintain the wiping bar in position.

2. The wiping bar of claim 1, wherein at least a portion of said path for said lubricant is coated with an anti-stick material.

3. The wiping bar of claim 1, wherein said first means for connecting includes a first plurality of bolts and wherein said second means for connecting includes a second plurality of bolts.

4. The wiping bar of claim 1 additionally comprising a first pair of brackets attached to said manifold body, each of said brackets of said first pair of brackets providing one said bearing surface.

5. The wiping bar of claim 1, wherein said means connected to said manifold body for positioning includes a second pair of brackets having a horizontal portion and a vertical portion, said vertical portion of each of said second pair of brackets being connected to said manifold body, said horizontal portion of each of said second pair of brackets having a threaded aperture therethrough carrying a threaded bolt of sufficient length to contact the base of the rail so as to position said distribution blade with respect to the railhead.

6. The wiping bar of claim 1, wherein each of said channels in said manifold body has a common beginning point and a unique end point, all of said channels being of substantially equal length.

7. The wiping bar of claim 1, wherein said portion of said path for said lubricant includes said channels of said manifold body.

8. The wiping bar of claim 1, wherein said portion of said path for said lubricant includes said channels of said distribution blade.

9. The wiping bar of claim 1, wherein said anti-stick material is teflon.

* * * * *